US006382811B1

(12) United States Patent
Bernard

(10) Patent No.: US 6,382,811 B1
(45) Date of Patent: May 7, 2002

(54) COMPONENT OF A SIGNALING COLUMN

(75) Inventor: Jacques Bernard, Angouleme (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/579,131

(22) Filed: May 30, 2000

(30) Foreign Application Priority Data

May 28, 1999 (FR) ..... 99 06824

(51) Int. Cl.[7] ..... F21V 5/00

(52) U.S. Cl. ..... 362/246; 362/249; 362/236; 362/252; 362/800

(58) Field of Search ..... 362/246, 800, 362/219, 222, 224, 226, 348, 349, 374, 375, 235, 240, 244, 336, 355, 356; 340/815.45, 815.76, 366 R, 381 R, 323 R; 40/130, 125

(56) References Cited

U.S. PATENT DOCUMENTS

| | | | | | |
|---|---|---|---|---|---|
| 3,555,543 A | * | 1/1971 | Lynch | 340/366 |
| 3,868,682 A | * | 2/1975 | Simon et al. | 340/366 R |
| 5,107,408 A | * | 4/1992 | Vernondier | 362/238 |
| 5,416,679 A | | 5/1995 | Ruskouski et al. | 362/240 |
| 5,575,459 A | | 11/1996 | Anderson | 362/240 |
| 5,642,933 A | * | 7/1997 | Hitora | 362/243 |
| 5,726,535 A | * | 3/1998 | Yan | 315/185 R |
| 5,769,532 A | * | 6/1998 | Saski | 362/237 |
| 6,135,612 A | * | 10/2000 | Clore | 362/184 |

FOREIGN PATENT DOCUMENTS

| | | | |
|---|---|---|---|
| DE | 43 21 823 | | 1/1995 |
| DE | 195 13 983 | | 10/1995 |
| DE | 297 19 399 | | 9/1998 |
| DE | 298 06 589 | | 10/1999 |
| FR | 2 649 778 A | * | 1/1991 |

* cited by examiner

*Primary Examiner*—Thomas M. Sember
*Assistant Examiner*—David V. Hobden
(74) *Attorney, Agent, or Firm*—Oblon, Spivak, McClelland, Maier & Neustadt, P.C.

(57) ABSTRACT

A component of a generally cylindrical luminous signaling column housing plural conductors that are substantially parallel to the axis of the cylinder and a printed circuit bearing plural LED luminous sources. The printed circuit is oriented such that its main plane is parallel to the axis of the component and bears plural LEDs on each surface. The cylindrical luminous signaling column includes a cylindrical inner surface provided with light-diffusing reliefs.

7 Claims, 2 Drawing Sheets

COMPONENT OF A SIGNALING COLUMN

BACKGROUND OF THE INVENTION

1. Field of the Invention

The present invention relates to a luminous column composed of generally cylindrical luminous components, at least one of which houses several conductors that are substantially parallel to the axis of the cylinder and a printed circuit bearing LED-type luminous sources.

2. Discussion of the Background

Luminous signaling devices or lamps are known that use LEDs arranged in several groups disposed in several planes offset from a general axis, the LEDs being distributed regularly around a circumference in each plane. This is achieved by installing the LEDs on several printed circuits offset in relation to the axis of the device. This type of device is used, for example, in road or maritime signaling.

SUMMARY OF THE INVENTION

Incandescent lamps are usually used in luminous columns containing superimposed luminous components designed for industrial use. It would be better to use LEDs.

The aim of the invention is therefore to provide an arrangement suitable for luminous columns containing superimposed luminous components, said arrangement being simple but nevertheless having good luminous efficiency.

According to the invention the printed circuit is oriented with its principal plane parallel to the axis of the cylinder and bears several LEDs on each surface.

Despite the bilateral disposition of the LEDs, the luminous efficiency of the column is excellent, in particular when the body of the luminous component is provided with diffusing components such as axial inner grooves the shape, pitch or spacing of which are predetermined.

The printed circuit may be disposed diametrically in the component with laterally-placed plates or flanges, one of which bears individual interconnecting conductors and the other a conductor common to the various components. The printed circuit may also be housed in a sealed bulb.

BRIEF DESCRIPTION OF THE DRAWINGS

The following description is of a non-limitative embodiment and refers to the attached figures where.

DISCUSSION OF THE PREFERRED EMBODIMENTS

Figure 1:
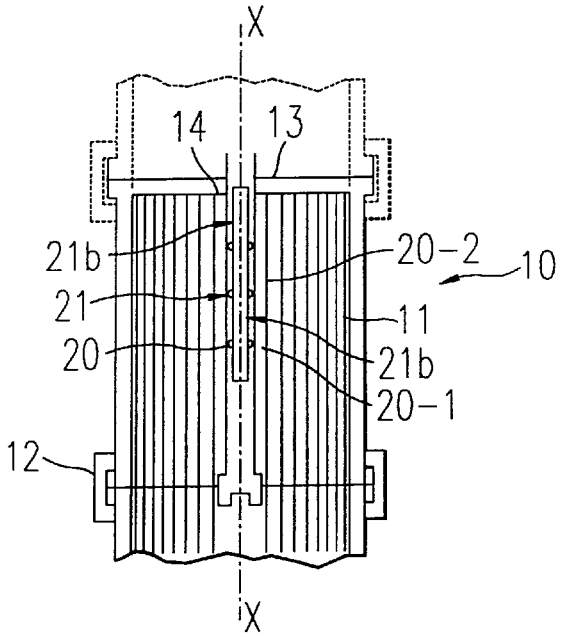
FIG. 1 shows schematically an axial section of a luminous component according to the invention.
Figure 2:
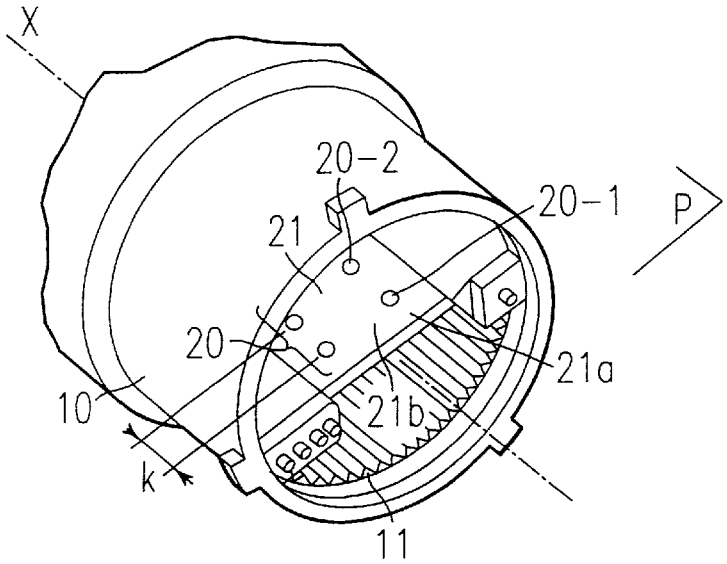
FIG. 2 shows the luminous component with the cover removed.

The luminous component shown in the figures is a signaling component of a luminous column. This type of column is composed of several components or lanterns that are superimposed to emit light of different colors that can be seen from all sides and that indicate the status of a machine, procedure, etc.

The luminous component comprises a cylindrical body 10 made of a translucent plastic material. Body 10 is cylindrical around axis X. Its outer surface is smooth but its inner surface is covered with a network of light-diffusing grooves or reliefs, particularly axial grooves 11 the shape and pitch of which are predetermined to produce optimal illumination on the whole periphery of the component. The upper and lower sections of body 10 are fitted with means 12 for fastening it to a base or the body of an adjoining component. The upper section of the body is closed off by a cover 13 fitted with apertures 14 enabling the component to be electrically connected to another component placed on top of it.

The component emits light by means of several LEDs 20 that are fitted laterally on the two surfaces 21*a*, 21*b* of a printed circuit 21. Printed circuit 21 is disposed parallel to the axis of symmetry X of the luminous component, which is preferably diametral, i,e. centered around this axis. The LEDs 20 may, for example, be eight in number, located back to back and divided into two groups of four on each surface. Each group is subdivided into sub-groups 20-1, 20-2 of two LEDs 20 axially offset by a distance h.

Figure 3:
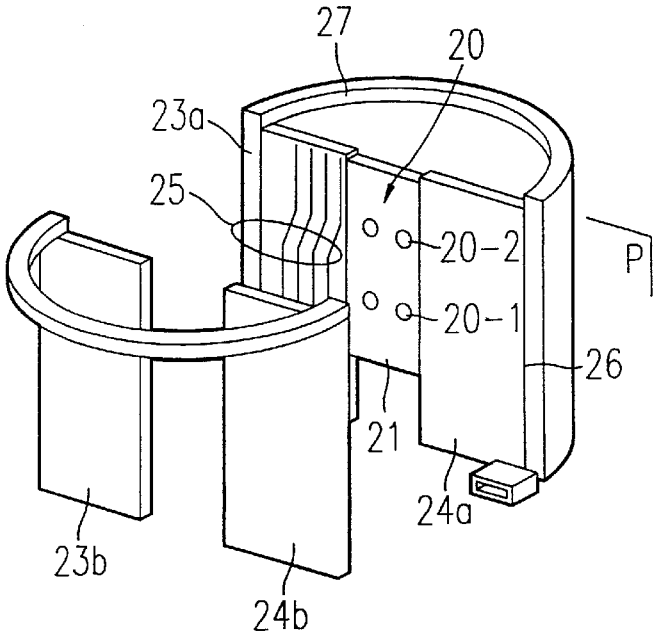
FIG. 3 is an exploded perspective view of the electric sub-assembly of the luminous component.
Figure 4:
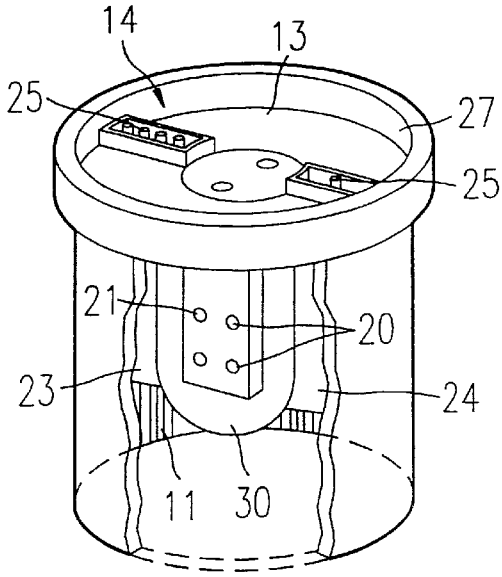
FIG. 4 is a perspective view of another version of an embodiment of the invention.

Two plates 23, 24 are located laterally to printed circuit 21. One of these plates bears and provides an insulated housing for individual power supply conductors 25 of the various superimposed luminous components while the other plate bears a conductor 26 common to the various luminous components. The conductor 25 assigned to the luminous component and common conductor 26 are connected laterally to the printed circuit to provide the power supply to groups of LEDs 20. It should be noted that printed circuit 21 and plates 23, 24 are located in the same diametral plane P and assembled to constitute a sub-assembly that can be fitted inside the body as a single unit. The plates are constructed by assembling half-plates 23*a*, 23*b* and 24*a*, 24*b* (FIG. 3) in order to insulate the conductors. The half-plates are held together by a disk- or crown-shaped support structure 27 that nests inside body 10 of the component and serves both to fit the sub-assembly inside the body and to contribute to the rigidity of the component.

In another version, printed circuit 21 bearing LEDs 20 on both its surfaces may be located inside a closed bayonet- or screw-type bulb 30. Together with interconnection supports 23, 24 this bulb forms a sub-assembly housed inside body 10 of the component. Bulb 30 is generally cylindrical in shape and its axis lies in axis X of the luminous component and parallel to inner grooves 11 of body 10.

What is claimed is:

1. A component of a luminous signaling column, said component being generally cylindrical in shape and housing plural conductors substantially parallel to the axis of the cylinder, comprising:

a printed circuit bearing plural LED light sources, the printed circuit having a single main plane and two opposite surfaces, wherein the printed circuit is oriented such that its main plane is parallel to the axis of the cylinder and bears plural LEDs on each of the two opposite surfaces, and at least two plates not integral with the printed circuit, each respectively bearing a conductor, that interconnect neighboring components of the column, the two plates being coplanar with the printed circuit.

2. A component of claim 1, wherein an inner surface of the cylinder is covered in light-diffusing reliefs.

3. A component of claim 2, wherein the light-diffusing reliefs are grooves parallel to the axis of the cylinder.

4. A component of claim 1, wherein the two plates and the printed circuit are located in a diametral plane of the component.

5. A component of claim 1, wherein the printed circuit is disposed diametrically between the two plates, one of the two plates supporting individual interconnecting conductors and the other of the two plates supporting a common conductor.

6. A component of claim 1, wherein the two plates and the printed circuit are fastened to a disk-shaped or crown-shaped structure that nests inside the component.

7. A component of claim 1, wherein the printed circuit is housed inside a bulb.

* * * * *